US009540828B2

(12) United States Patent
Rastegar et al.

(10) Patent No.: US 9,540,828 B2
(45) Date of Patent: Jan. 10, 2017

(54) METHODS, APPARATUS AND KITS FOR MEASURING AND CUTTING IRREGULAR SHAPED ITEMS

(71) Applicants: Jahangir S Rastegar, Stony Brook, NY (US); Thomas Spinelli, Northport, NY (US)

(72) Inventors: Jahangir S Rastegar, Stony Brook, NY (US); Thomas Spinelli, Northport, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 233 days.

(21) Appl. No.: 14/147,565

(22) Filed: Jan. 5, 2014

(65) Prior Publication Data

US 2015/0191920 A1 Jul. 9, 2015

(51) Int. Cl.
*E04F 21/00* (2006.01)
*E04F 21/22* (2006.01)

(52) U.S. Cl.
CPC ..... *E04F 21/22* (2013.01); *E04F 21/0076* (2013.01)

(58) Field of Classification Search
CPC ..... E04F 21/20; B25H 7/02
USPC ..... 33/527, 562–566
See application file for complete search history.

(56) References Cited

U.S. PATENT DOCUMENTS

| | | | | | |
|---|---|---|---|---|---|
| 1,997,287 | A * | 4/1935 | Adler | A45C 11/36 | 33/23.02 |
| 2,795,854 | A * | 6/1957 | Perkal | B25H 7/00 | 33/527 |
| 4,502,232 | A * | 3/1985 | Broders | A47G 27/0487 | 33/479 |
| 5,429,241 | A * | 7/1995 | Althaus | A45D 27/29 | 206/352 |
| 5,590,785 | A * | 1/1997 | Seitzinger | B44D 3/02 | 206/1.8 |
| 6,729,035 | B1 * | 5/2004 | Carrillo | E04F 21/0076 | 33/526 |
| 6,834,438 | B1 * | 12/2004 | Heister | E04F 21/0076 | 33/1 B |
| 7,028,412 | B2 * | 4/2006 | Boomershine | E04F 21/20 | 33/526 |
| 7,363,720 | B2 * | 4/2008 | DiGavero | B25H 7/02 | 33/528 |
| 7,467,476 | B2 * | 12/2008 | Digavero | B25H 7/02 | 33/528 |
| 7,854,073 | B1 * | 12/2010 | Webb | B25H 7/02 | 33/1 G |
| 2003/0061722 | A1 * | 4/2003 | Bradley | E04G 21/18 | 33/563 |

(Continued)

*Primary Examiner* — Yaritza Guadalupe-McCall

(57) ABSTRACT

A method for measuring and cutting a tile. The method including: laying tiles other than the tile to be cut to define a space corresponding to the tile to be cut; arranging a plurality of pieces in the space to cover at least a portion of a surface area of the space, the plurality of pieces sticking together to form a tile blank; removing the tile blank from the space; and transferring dimensions of the tile blank to an uncut tile. Also provided is a kit for measuring a tile. The kit including a plurality of flat pieces, the plurality of flat pieces being formed in at least one of a plurality of different shapes and a plurality of different sizes, the plurality of flat pieces being capable of sticking to each other.

20 Claims, 9 Drawing Sheets

(56) References Cited

U.S. PATENT DOCUMENTS

| | | | | |
|---|---|---|---|---|
| 2004/0123477 | A1* | 7/2004 | Kauth | B42D 1/006 33/562 |
| 2005/0055837 | A1* | 3/2005 | Boomershine | E04F 21/20 33/526 |
| 2005/0257391 | A1* | 11/2005 | Driscoll | E04F 21/00 33/566 |
| 2008/0155845 | A1* | 7/2008 | Digavero | E04F 21/00 33/528 |
| 2009/0313841 | A1* | 12/2009 | Calleros | G01B 3/14 33/528 |
| 2013/0061483 | A1* | 3/2013 | Wynn | B43L 7/00 33/566 |
| 2015/0191920 | A1* | 7/2015 | Rastegar | E04F 21/22 33/527 |

* cited by examiner

METHODS, APPARATUS AND KITS FOR MEASURING AND CUTTING IRREGULAR SHAPED ITEMS

BACKGROUND OF THE INVENTION

1. Field of the Invention

The present invention relates generally to methods, devices and kits for measuring and cutting items and, more particularly, measuring and cutting tiles, and in particular, tiles having an irregular/complex shape.

2. Prior Art

When laying tiles on a flat surface, such as a floor or wall, tile setters typically set the tiles in an adhesive, first in full tiles and then in the tiles that require cutting. To cut the latter, the tile setter generally creates a space with the full tiles in which the cut tile will be placed and then measures the various dimensions of the space. The tile setter then records the dimensions and possibly sketches the shape of the tile with the dimensions. The tile setter then transfers the dimensions to a tile and cuts the tile according to the dimensions. As the complexity of the shape to be cut increases, the complexity also increases for the measuring and recording of the dimensions/shape of the tile to be cut. Tiles to be cut having a complex shape often result in poorly fitting tiles or several attempts at cutting tiles before an acceptable one is cut. Therefore, cutting the tiles, particularly those with complex shapes, usually results in either a poor appearance of the cut tiles in the overall pattern, increased time to finish laying the tile and/or increased costs due to the increased time and the extra tiles used in the cutting.

SUMMARY OF THE INVENTION

Accordingly, a method for measuring and cutting a tile is provided. The method comprising: laying tiles other than the tile to be cut to define a space corresponding to the tile to be cut; arranging a plurality of pieces in the space to completely cover a surface area of the space, the plurality of pieces sticking together to form a tile blank; removing the tile blank from the space; and transferring dimensions of the tile blank to an uncut tile.

The transferring can comprise placing the tile blank on the tile to be cut and tracing an outline of the tile blank onto the tile to be cut.

The method can further comprise cutting the uncut tile according to the transferred dimensions from the tile blank.

The plurality of pieces can stick together by a magnetic attraction to each other.

A kit for measuring a tile is also provided. The kit comprising a plurality of flat pieces, the plurality of flat pieces being formed in at least one of a plurality of different shapes and a plurality of different sizes, the plurality of flat pieces being capable of sticking to each other.

The plurality of flat pieces can be formed of magnetic sheet which stick to each other by magnetic attraction. The plurality of flat pieces can further include a plastic layer adhered to the magnetic sheet.

The plurality of flat pieces can be formed in a plurality of different shapes including one or more of squares, rectangles, triangles and complex shapes. The complex shapes can include a rectangle having a plurality of kerf cuts. At least some of the plurality of different shapes can also be formed in a plurality of different sizes.

The kit can further comprise a marking instrument configured to mark a tile surface. The marking instrument can be a wax pencil.

The kit can further comprise a package for containing the plurality of flat pieces. The package can be at least partially formed of a transparent material. The package can include a display means for facilitating display of the package in a retail store. The display means can be a hole formed in a portion of the package.

Still further provided is a tile blank comprising a plurality of flat pieces formed from one or more of a plurality of shapes and sizes that are stuck together to form a shape of a tile to be cut.

The plurality of flat pieces can be formed of magnetic sheet having a magnetic attraction to each other. The plurality of flat pieces can further include a plastic layer adhered to the magnetic sheet.

Still further yet provided is a method for measuring and cutting an item. The method comprising: defining a space corresponding to the item to be cut; arranging a plurality of pieces in the space to completely cover a surface area of the space, the plurality of pieces sticking together to form an item blank; removing the item blank from the space; and transferring dimensions of the item blank to a full item.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Although the methods and devices disclosed herein are useful for measuring and/or cutting many different items, they have particular utility for cutting measuring and/or cutting tiles. Therefore, the methods and devices will be described herein with regard to tiles.

Figure 1:
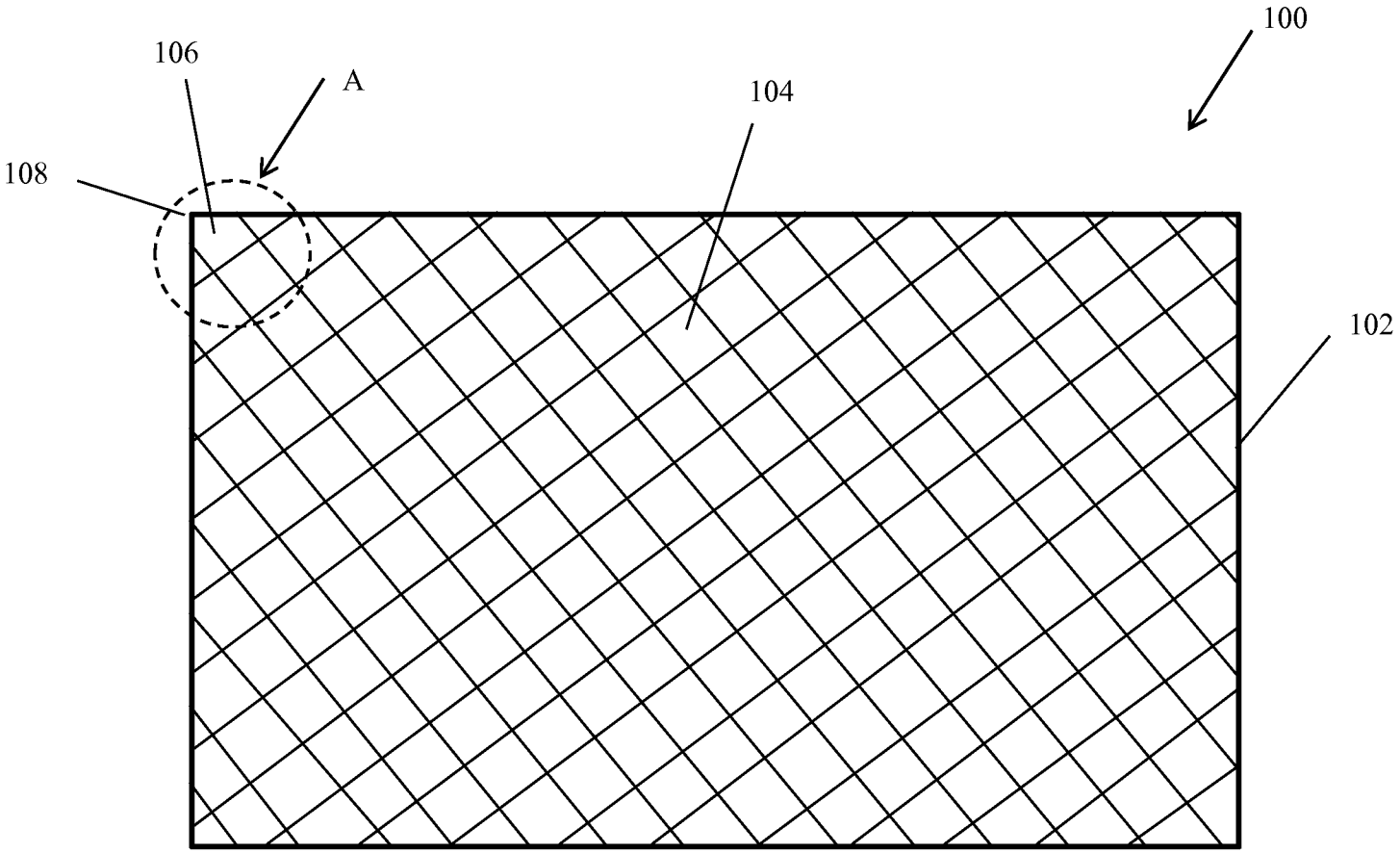
FIG. 1 illustrates an exemplary plan view of a room having an angled layout of square tiles.

Referring now to FIG. 1, there is illustrated a room layout 100 showing a boundary 102 within which a plurality of tiles 104 are to be laid in a predetermined pattern. The boundary can be the walls of the room or a portion thereof. The pattern can be parallel with the boundary or angled with respect to the boundary, as is shown in FIG. 1. The pattern shown in FIG. 1 can also include a spacing between the tiles for a grout line.

Figure 2:
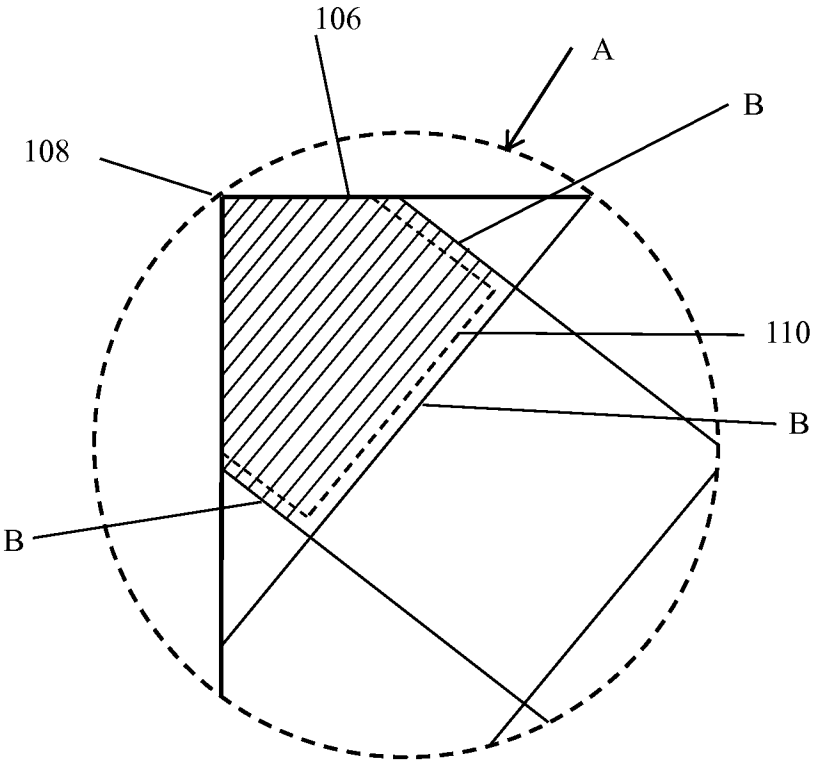
FIG. 2 illustrates a close-up view of detail A from FIG. 1.

Referring now to FIG. 2, there is shown a detail A from FIG. 1. In FIG. 2, the detail A is enlarged to show the specific details thereof. Detail A shows a tile shape 106 (shown cross hatched) for a corresponding tile, which must be cut into an irregular shape due to the specific pattern of the room layout 100 and how such pattern carries out at the corner 108 of the boundary 102. As can be appreciated by those skilled in the art, cutting a tile having the tile shape 106 can be difficult. As discussed above, if a grout line 110 (shown in broken line) is desired, the tile shape 106 must be cut to take into account the thickness of the grout line 110 at the sides B of the tile shape that abut other tiles.

Figure 3A:
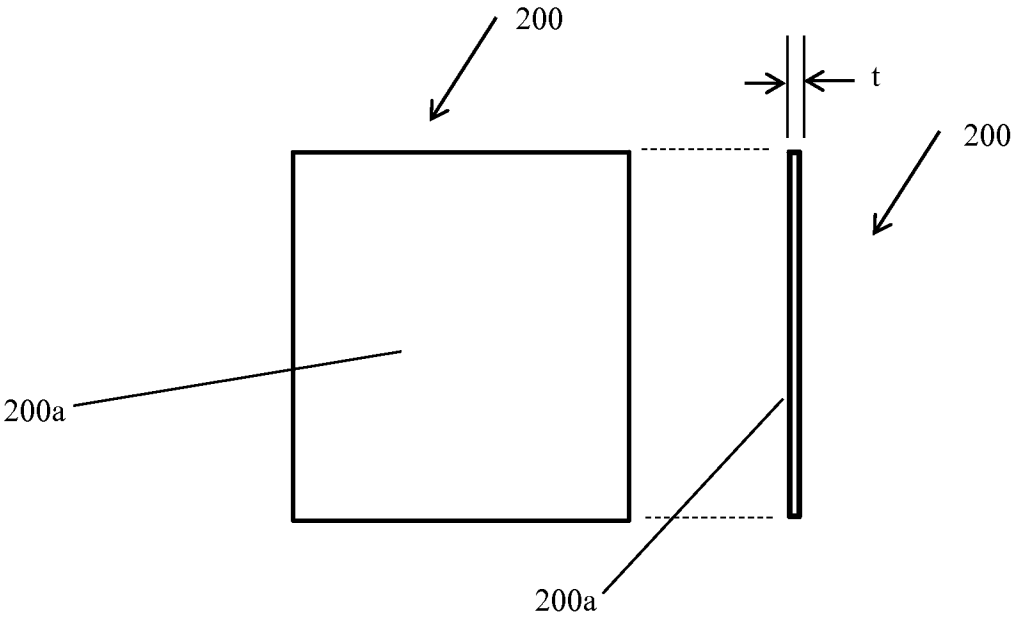
FIG. 3*a* illustrates a top and side view of an exemplary device for measuring and cutting one of more of the tiles illustrated in FIG. 2 and in particular, the shaded tile to be measured and cut in FIG. 2.

FIG. 3*a* shows an individual piece 200 of a kit (discussed below) for assisting a user in cutting complex/irregular tile shapes, such as the tile shape 106 shown in FIGS. 1 and 2. The individual piece 200 is a certain shape (such as square as shown in FIG. 3*a*) and a certain size, has a relatively thin thickness t and is relatively flat. The material/property of the individual piece 200 is such that it easily sticks to other similar pieces, as described below. The individual piece 200 can be formed of a magnetic sheet which sticks to other pieces by magnetic attraction. The magnetic sheet can further include a plastic layer 200*a* adhered to one or more faces of the magnetic sheet. Although magnetic attraction is preferred, other means can be provided for the individual piece 200 to stick to another individual piece, such as an electrostatic attraction. In this regard, the individual piece 200 can be a plastic sheet having a positive or negative charge.

Figure 3B:
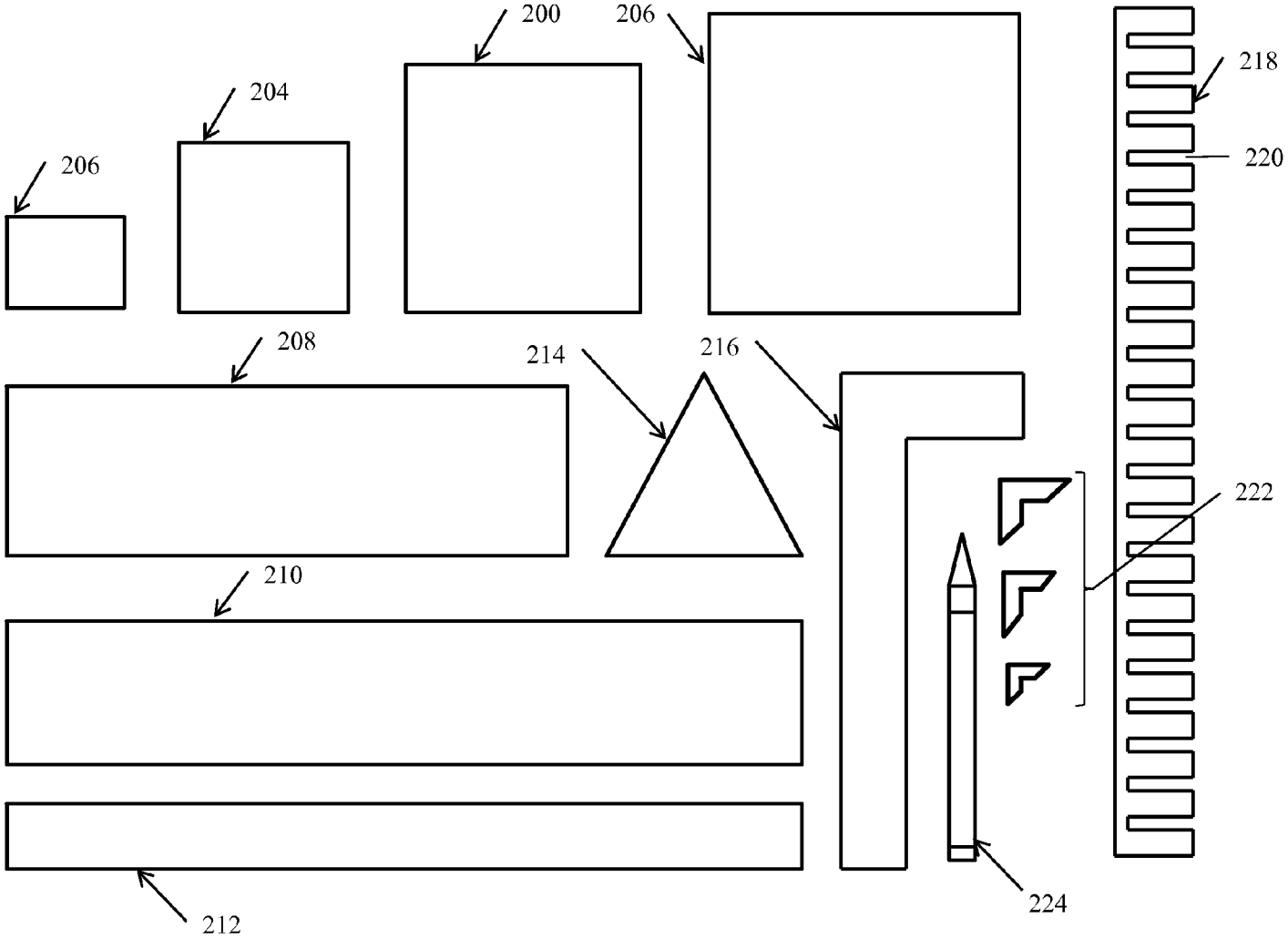
FIG. 3*b*, illustrates a kit of the devices of FIG. 3*a* in various shapes and sizes, as well as a wax pencil for marking a tile for cutting.

Referring now to FIG. 3*b*, there is illustrated a variety of individual pieces of varying shape and size which are capable of sticking to each other. For example, the variety of individual pieces can be various size squares 200, 202, 204, 206. Rectangular shapes in various sizes 208, 210 and 212 as well as one or more triangle shapes 214 can also be provided. Other shapes can also be provided, such as circles, semicircles etc (not shown) as well as complex shapes pieces, such as an L shaped piece 216. The complex shaped pieces can also include a rectangle 218 having a plurality of kerf cuts 220 to facilitate curving the rectangle 218 along a curved line. If a grout line 110 is desired, grout spacers 222 can also be provided in various thicknesses corresponding to typical grout line thicknesses. Also provided is a marking instrument, such as a wax pencil configured to mark a tile surface.

Figure 6:
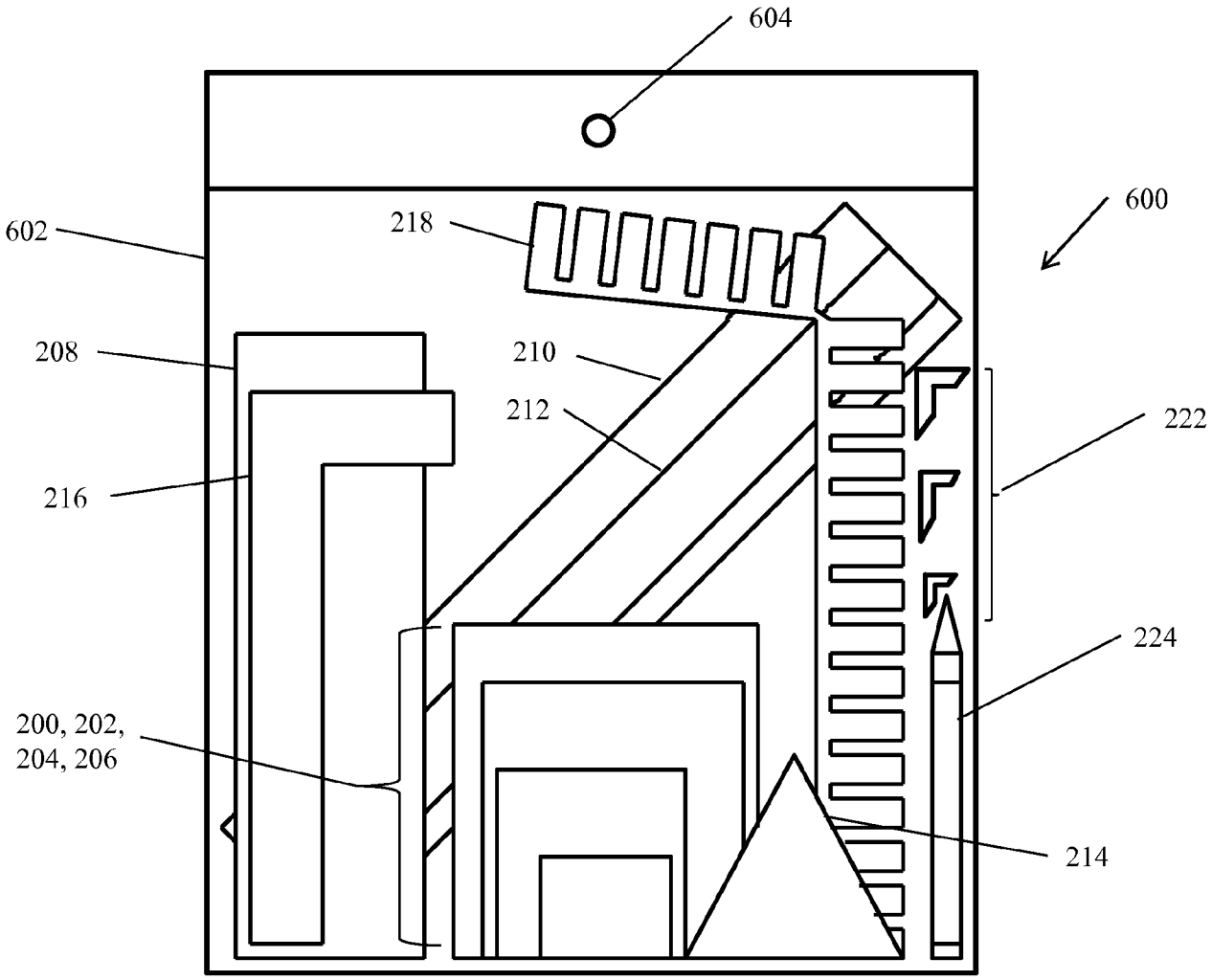
FIG. 6 illustrates the kit of FIG. 3*b* packaged for display on a store shelf.

All of the items illustrated in FIG. 3*b* (including more or less shaped pieces) can be provided in a kit, such as being disposed in a package 600 (see FIG. 6) for containing the variety of flat pieces 200-218, grout spacers 222 and marking instrument 224. The package 600 can be at least partially formed of a transparent material 602 and include a display means for facilitating display of the package in a retail store, such as having a hole 604 formed in a portion of the package 600 to facilitate hanging the package on a display rod.

Figure 4A:
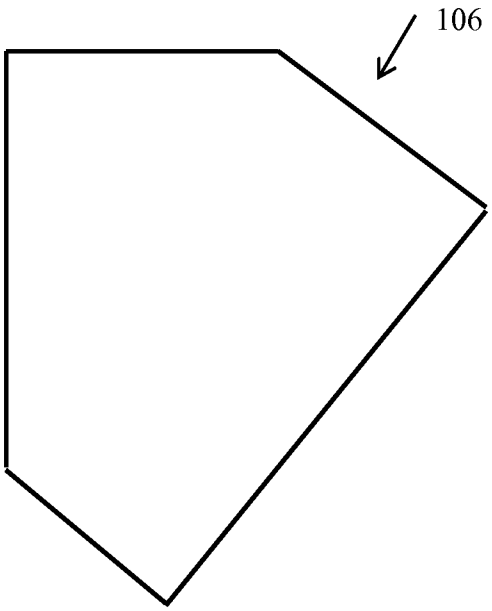
FIG. 4*a* illustrates the shape to be cut for the corresponding area shown in hatched lines in FIG. 2.

Referring now to FIG. 4*a*, there is shown the shape and size of the tile shape 106 that must be transferred to a full tile to mark the same for cutting along the marks. The tile shape 106 corresponds to an open space 106*a* on the floor to be tiled corresponding to the tile blank 106. That is, as the floor is tiled around the tile shape 106, an open space 106*a* is created corresponding to the tile shape 106. The size and shape of the open space 106*a*, minus any grout line, is to be transferred to a full tile so as to cut the full tile to correspond to the open space 106*a*, minus any grout line, if desired.

Figure 4B:
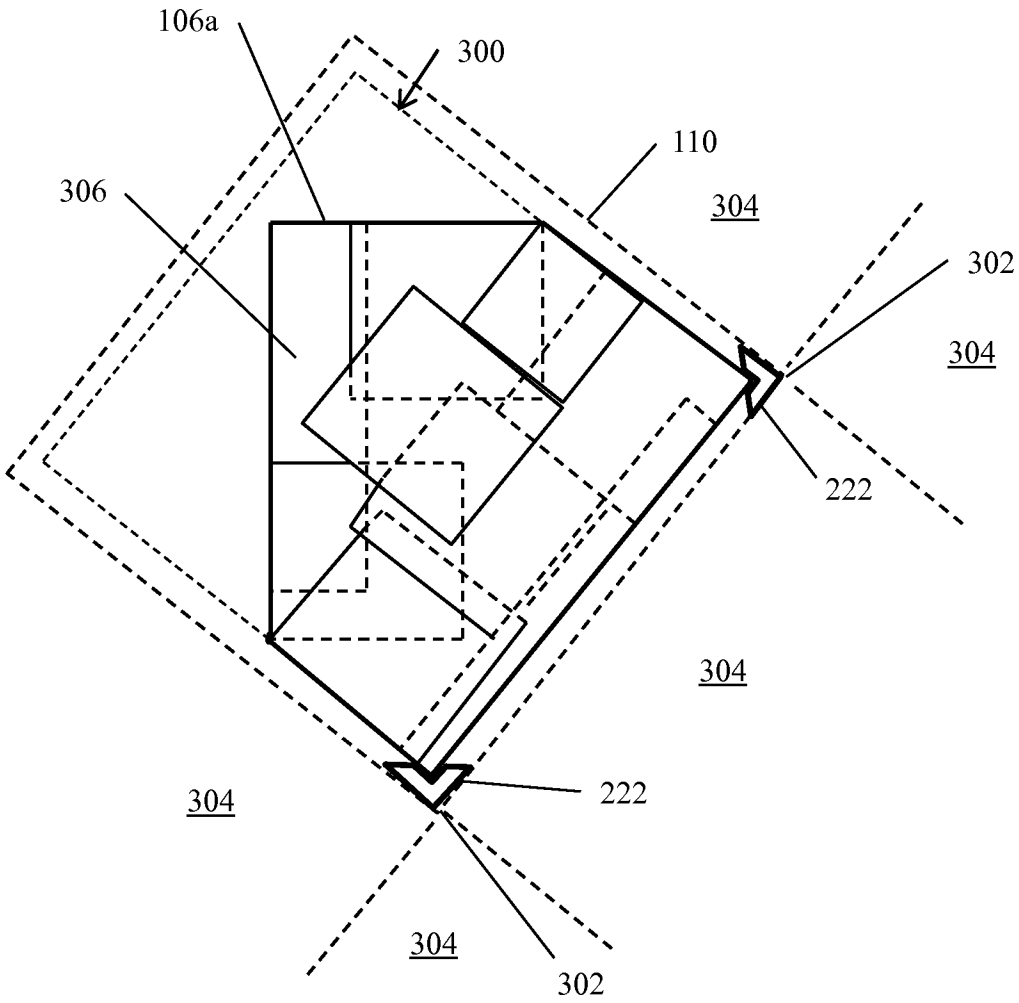
FIG. 4*b* illustrates the shape to be cut as shown in FIG. 4*a* with the devices of FIGS. 3*a* and 3*b* arranged to overlay the shape and with a full size of a tile extended in broken lines.

Referring now to FIG. 4*b*, the open space 106*a* is shown superimposed on the size and shape of a full tile 300. The variety of pieces 200-218 are laid in the open space in a way so as to at least define the perimeter of the open space 106*a*, or to define the entire open space 106*a*. Of course, if a grout line 110 is desired, an appropriately sized grout spacer 222 is set in the corners 302 of the open space 106*a* where corners of adjacent tiles 304 meet. As shown in FIG. 4*b*, the variety (alternatively referred to as a plurality) of pieces 200-218 can be used in different combinations, using all or less than all, of the pieces 200-218, stuck together to form a tile blank 306 corresponding with a shape and size of a tile to be cut. The tile pieces 200-218 shown in FIG. 3*b* are shown by way of example only, other sizes and shapes are possible as are multiples of the same sizes and shapes. The tile blank 306 can then be removed from the open space 106*a* and laid on top of a full tile 300, where the shape of the tile blank 306 is transferred to the full tile 300, such as with the marking instrument 224. The full tile 300 can then be easily cut along the markings and the resulting cut tile used to fill the open space 106*a*. Such procedure can be repeated for any tiles in the pattern that need to be cut, such as those having an irregular or complex shape.

Figure 5A:
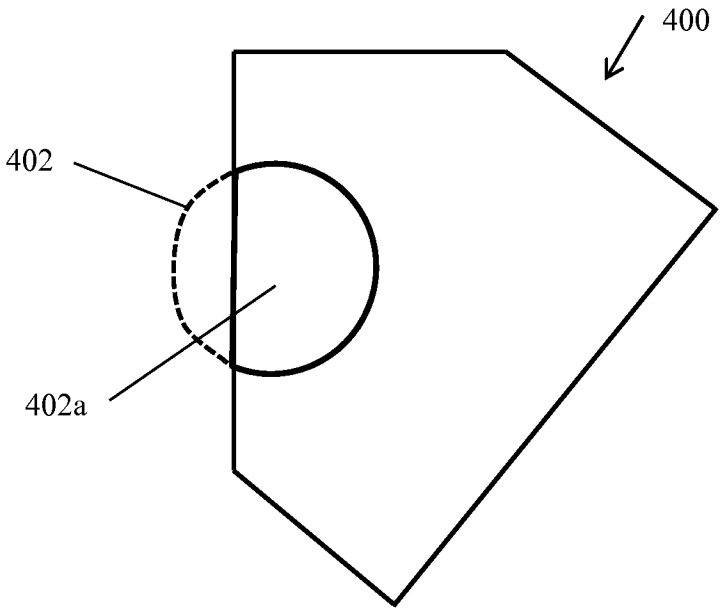
FIG. 5*a* illustrates a modification of the shape to be cut for the corresponding area shown in hatched lines in FIG. 2, with the addition of a partial column disposed within the area to be cut.

Referring now to FIG. 5*a*, there is shown the shape and size of the tile shape 400 that must be transferred to a full tile to mark the same for cutting along the marks. In FIG. 5*a*, the shape to be cut is modified from that in FIG. 4*a* with the addition of a partial column disposed within the area to be cut. That is, the open space 106*b* includes a column 402, a portion of which 402*a* is included in the open space 106*b*. The tile shape corresponds to the open space 106*b* on the floor to be tiled.

Figure 5B:
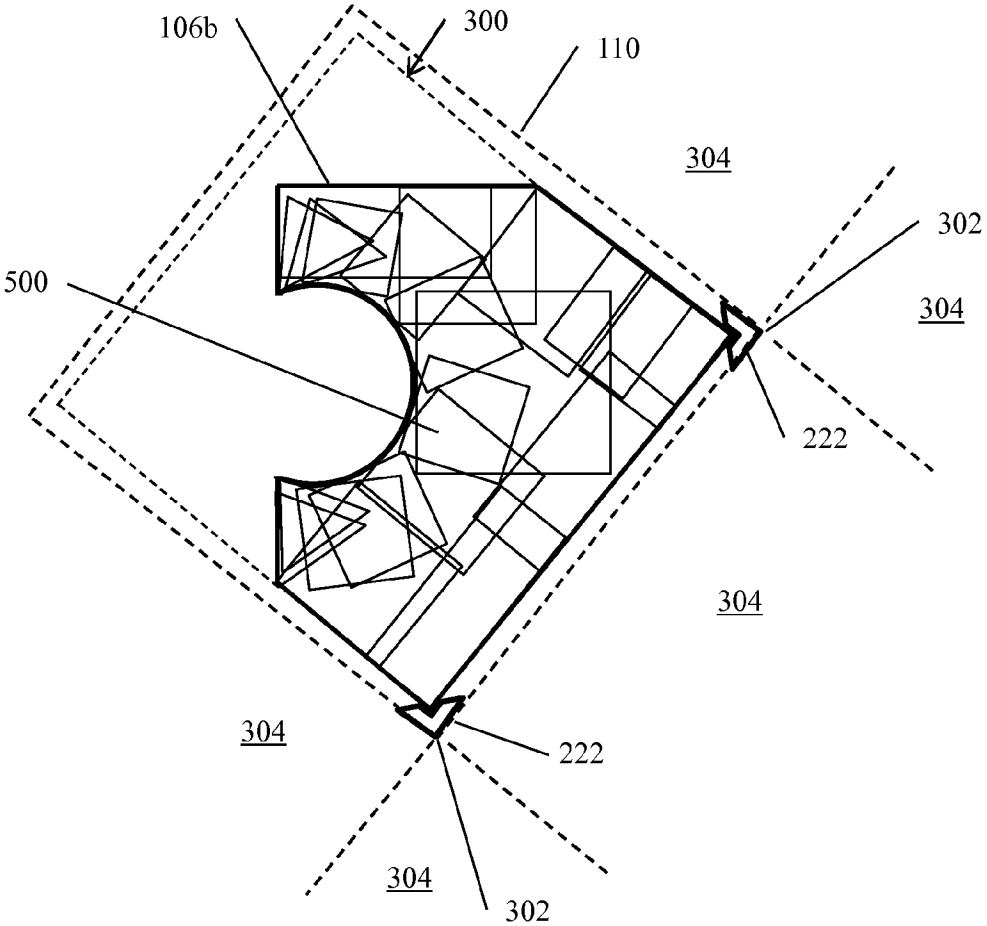
FIG. 5*b* illustrates the shape to be cut as shown in FIG. 5*a* with the devices of FIGS. 3*a* and 3*b* arranged to overlay the shape and with a full size of a tile extended in broken lines.

Referring now to FIG. 5*b*, the open space 106*b* is shown superimposed on the size and shape of a full tile 300. The variety of pieces 200-218 are laid in the open space in a way so as to at least define the perimeter of the open space 106*b*, or define the entire open space 106*b*. As discussed above with regard to FIG. 4*b*, if a grout line 110 is desired, an appropriately sized grout spacer 222 is set in the corners 302 of the open space 106*b* where corners of adjacent tiles 304 meet. As shown in FIG. 5*b*, the variety (alternatively referred to as a plurality) of pieces 200-218 can be used in different combinations, using all or less than all, of the pieces 200-218, stuck together to form a tile blank 500 corresponding with a shape and size of a tile to be cut. Of course, the tile pieces 200-218 shown in FIG. 3*b* are shown by way of example only, other sizes and shapes are possible as are multiples of the same sizes and shapes. The tile blank 500 can then be removed from the open space 106*b* and laid on top of a full tile 300, where the shape of the tile blank 500 is transferred to the full tile 300, such as with the marking instrument 224. The full tile 300 can then be easily cut along the markings and the resulting cut tile used to fill the open space 106*b*. Such procedure can be repeated for any tiles in the pattern that need to be cut, such as those having an irregular or complex shape.

In FIG. 5*b*, the curved edge of the open space 106*b* defined by a portion of the column 402 is defined with a plurality of square pieces 200 arranged next to each other and slightly angled with respect to adjacent ones. However, the rectangle 218 piece with kerf cuts 220 can be used and curved around the column outline.

Those skilled in the art will recognize that the arrangement of the plurality of pieces 200-218 in the open space 106*a*/106*b* where the individual pieces 200-218 stick together to form a tile blank 306/500 that can be removed from the open space and transferred to a full tile is a simple, easy and inexpensive way of transferring complex/irregular shapes to full tiles and cutting the same. Further, the pieces 200-218 are easily cleaned and reused, particularly when coated with the plastic layer 200*a* or fabricated from plastic.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for measuring and cutting a tile, the method comprising:

laying tiles other than the tile to be cut to define a space corresponding to the tile to be cut;

arranging a plurality of separate pieces in the space to cover at least a portion of a surface area of the space, the plurality of separate pieces sticking together to form a single tile blank;

removing the single tile blank from the space; and transferring dimensions of the single tile blank to an uncut tile.

2. The method of claim 1, wherein the transferring comprises placing the single tile blank on the tile to be cut and tracing at least a portion of an outline of the single tile blank onto the tile to be cut.

3. The method of claim 1, further comprising cutting the uncut tile according to the transferred dimensions from the single tile blank.

4. The method of claim 1, wherein the plurality of separate pieces sticking together by a magnetic attraction to each other.

5. A kit for measuring a tile, the kit comprising a plurality of separate flat pieces, the plurality of separate flat pieces being formed in at least one of a plurality of different shapes and a plurality of different sizes, the plurality of separate flat pieces being capable of sticking to each other.

6. The kit of claim 5, wherein the plurality of separate flat pieces are formed of magnetic sheet which stick to each other by magnetic attraction.

7. The kit of claim 6, wherein the plurality of separate flat pieces further include a plastic layer adhered to the magnetic sheet.

8. The kit of claim 5, wherein the plurality of separate flat pieces are formed in a plurality of different shapes including one or more of squares, rectangles, triangles and complex shapes.

9. The kit of claim 8, wherein the complex shapes includes a rectangle having a plurality of kerf cuts.

10. The kit of claim 8, wherein at least some of the plurality of different shapes are also formed in a plurality of different sizes.

11. The kit of claim 5, further comprising a marking instrument configured to mark a tile surface.

12. The kit of claim 11, wherein the marking instrument is a wax pencil.

13. The kit of claim 5, further comprising a package for containing the plurality of flat pieces.

14. The kit of claim 13, wherein the package is at least partially formed of a transparent material.

15. The kit of claim 13, wherein the package includes a display means for facilitating display of the package in a retail store.

16. The kit of claim 15, wherein the display means is a hole formed in a portion of the package.

17. A tile blank comprising a plurality of separate flat pieces formed from one or more of a plurality of shapes and sizes that are stuck together to form at least a portion of a shape of a tile to be cut.

18. The tile blank of claim 17, wherein the plurality of separate flat pieces are formed of magnetic sheet having a magnetic attraction to each other.

19. The tile blank of claim 18, wherein the plurality of separate flat pieces further include a plastic layer adhered to the magnetic sheet.

20. A method for measuring and cutting an item, the method comprising:

defining a space corresponding to the item to be cut;

arranging a plurality of separate pieces in the space to cover at least a portion of a surface area of the space, the plurality of pieces sticking together to form an item blank;

removing the item blank from the space; and transferring dimensions of the item blank to a full item.

* * * * *